United States Patent [19]

Robson

[11] 4,421,320

[45] Dec. 20, 1983

[54] BOOMERANG

[76] Inventor: David P. Robson, 4602 Schenley Rd., Baltimore, Md. 21210

[21] Appl. No.: 367,847

[22] Filed: Apr. 13, 1982

Related U.S. Application Data

[63] Continuation of Ser. No. 110,420, Jan. 7, 1980, abandoned.

[51] Int. Cl.[3] ..... A63B 65/08

[52] U.S. Cl. ..... 273/425; 273/426

[58] Field of Search ..... 273/424–426; 46/74 D, 82–85

[56] References Cited

U.S. PATENT DOCUMENTS

| | | | |
|---|---|---|---|
| 692,608 | 2/1902 | Bristow | 273/426 |
| 2,324,022 | 7/1943 | Prause, Jr. | 273/426 |
| 3,036,832 | 5/1962 | Ellman et al. | 46/85 X |
| 3,082,572 | 3/1963 | Knox, Jr. | 273/426 X |
| 3,565,434 | 2/1971 | Liston | 273/426 |
| 3,742,643 | 7/1973 | Keith | 46/74 D |
| 3,955,817 | 5/1976 | Davis | 273/425 |
| 4,045,029 | 8/1977 | Katzmark | 273/425 |
| 4,203,249 | 5/1980 | Bohm | 273/426 |
| 4,222,573 | 9/1980 | Adler | 273/426 |

FOREIGN PATENT DOCUMENTS

| | | | |
|---|---|---|---|
| 746643 | 3/1956 | United Kingdom | 46/83 |

*Primary Examiner*—Paul E. Shapiro

[57] ABSTRACT

The disclosure is directed to a multi-arm boomerang with a structural configuration with permits simple modification of operational flight characteristics. The boomerang comprises a plurality of airfoil-shaped arms spaced about a central axis with an airfoil-shaped control device, preferably in the form of a ring, interconnecting the arms. By altering the cross sectional shape of the control device means, the flight characteristics of the boomerang may be modified. Furthermore, by constructing the disclosed boomerang of a resilient material there is created an entertainment device with safety features far in advance of those heretofore known.

6 Claims, 9 Drawing Figures

BOOMERANG

This is a continuation of application Ser. No. 110,420 filed Jan. 7, 1980, now abandoned.

BACKGROUND OF THE INVENTION

The instant invention is directed generally to entertainment devices which are adapted to be thrown into the air to produce a "flying" effect, and specifically to a boomerang with improved operational and flight characteristics.

The term "boomerang" is sometimes used to encompass all manner of "flying" devices; however, it should be noted here that the proper definition, and the one to be used herein, includes a narrower class of articles. More specifically, a boomerang is an aerodynamic device which, when thrown with an initial trajectory which is largely parallel to the ground describes a generally circular flight path and returns to the thrower. Devices which, when thrown upwardly at an angle "slide" back to the thrower, such as the common "Frisbee" are not boomerangs.

Referring to FIG. 1, a three dimensional picture of a returning throw of a true boomerang can be seen. An imaginery cylinder of vertical lines is added to clarify the orientation of the boomerang 20 (shown as a disc). From this it can be seen that there are three basic motions which the boomerang 20 performs during flight. First, it moves forward through the air while spinning end over end. Secondly, the boomerang makes a sweeping left turn around a roughly circular path defined generally by the periphery of the cylinder 10. Thirdly, the boomerang "lays down" during flight, i.e., the angle of the disc changes from nearly vertical to horizontal. A successful boomerang must have these three motions in proper balance.

The invention to be disclosed is limited to multi-arm devices, i.e., devices with three or more arms, so the remaining discussion will be directed to the characteristics of such devices. Throughout this disclosure, right-handed boomerangs are described, but it should be understood that the invention may be applied to left-handed boomerangs as well. In construction, a left-handed boomerang is a mirror image of a right-handed boomerang. In flight, a left-handed boomerang circles to the right instead of to the left.

Normally, the objective of flight modification is accomplished by tailoring the lay-down motion to match the turing motion. A boomerang which lays down too rapidly or too slowly cannot produce a good flight. For boomerangs with more than two arms, the conventional means of controlling lay-down is to bend the arms up or down to create positive or negative dihedral, respectively. FIG. 2A shows a boomerang 20 with positive dihedral. The flat side of boomerang 20 is down, resting on surface 21. FIG. 2B shows negative dihedral in boomerang 20 with its flat side down toward surface 21.

As will be understood shortly, the invention disclosed herein includes a novel control ring which eliminates the need for dihedral in multi-arm boomerangs, thus eliminating the difficulties associated with the proper balancing thereof with the turning motion of a specific boomerang. Also, the novel control concepts disclosed permit the construction of a boomerang of flexible materials—heretofore impossible because of the requirement for the inclusion of dihedral bending.

BRIEF SUMMARY OF THE INVENTION

It is an object of the instant invention to provide a boomerang having a novel means for controlling the lay-down characteristics thereof.

It is a feature of the instant invention that a multi-arm boomerang includes a control member having an airfoil-shaped cross section, the modification of which controls the lay-down characteristics of the boomerang.

It is another feature of the instant invention that a multi-arm boomerang includes a control member with an airfoil-shaped cross section, providing lift toward the top of the boomerang.

It is another feature of the instant invention that a multi-arm boomerang includes a control member with an airfoil-shaped cross section, providing lift toward the bottom of the boomerang.

It is another feature of the instant invention that a multi-arm boomerang includes a control member in a form of a ring with an airfoil-shaped cross section.

It is another object of the instant invention to provide a multi-arm boomerang which includes an airfoil-shaped, generally opened centered, control means interconnecting the arms.

It is a further feature of the instant invention that the control means and arms of the boomerang are statically balanced about a central axis.

It is another feature of the instant invention that the arms of the boomerang are radial and spaced symmetrically about a central axis.

It is a still further object of the instant invention to provide a generally planar boomerang including a plurality of airfoil-shaped arms spaced about the central axis and a generally opened centered control means interconnecting the arms, the boomerang being made of a resilient material.

It is a further feature of the instant invention that the arms of the boomerang, when impacted by a force, bend, and the arms/control means junctures and control means flex.

These and other objects and features are accomplished by providing a multi-arm boomerang with a structural configuration which permits a simple modification of operational flight characteristics. The boomerang comprises a plurality of airfoil-shaped arms spaced about a central axis with an airfoil-shaped control means, preferably in the form of a ring, interconnecting the arms. By altering the cross sectional shape of the control means, the flight characteristis of the boomerang may be modified. Furthermore, by constructing the disclosed boomerang of a resilient material there is created an entertainment device with safety features far in advance of those heretofore known.

BRIEF DESCRIPTION OF THE DRAWINGS

The advantages of this invention will become apparent upon consideration of the following detailed disclosure of the invention especially when taken in conjunction with the accompanying drawings wherein.

DESCRIPTION OF THE PREFERRED EMBODIMENT

Figure 1:
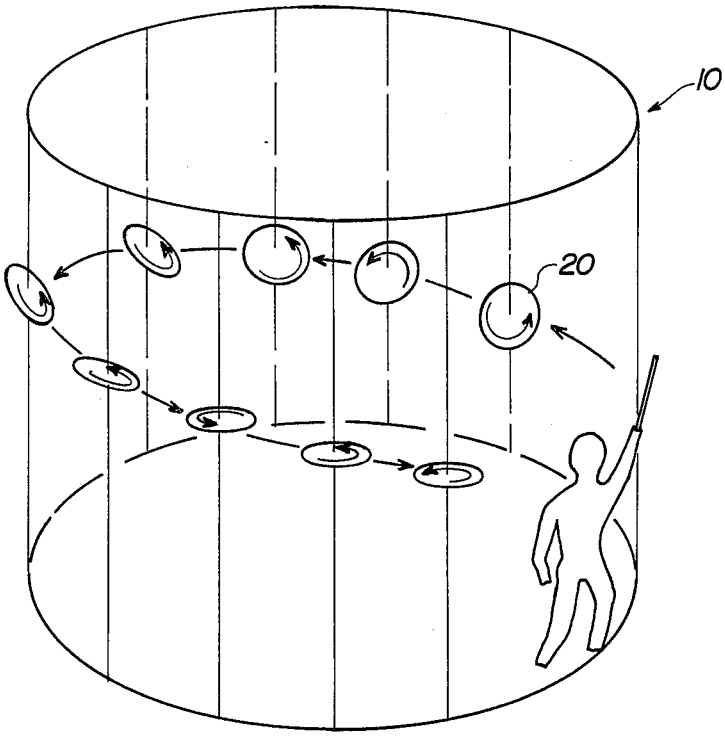
FIG. 1 is a schematic representation of the flight characteristics of a boomerang.
Figure 2A:
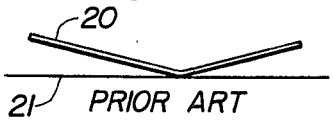
FIGS. 2*a* and 2*b* are schematic representations of positive and negative dihedral, respectively.
Figure 2B:
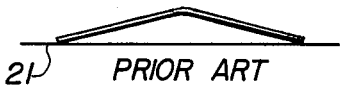
Figure 3:
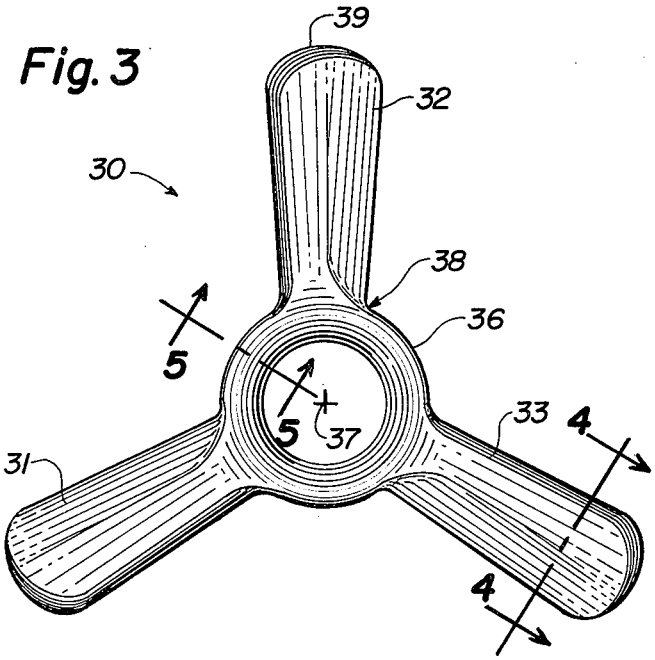
FIG. 3 is a top plan view of the preferred embodiment of the boomerang of the instant invention, showing a control means in the form of a ring.

Referring to the remaining figures and especially to FIG. 3, the preferred embodiment of the instant invention can be seen generally as a boomerang 30. The structure is shown to comprise three arms 31, 32 and 33 interconnected centrally by a ring 36. Each of the arms, and the ring, are airfoil-shaped, as will be described below, to provide the required aerodynamic characteristics for return flight. Every boomerang has at least two arms, but the instant invention is directed to boomerangs having more than two. The term "multi-arm" as used herein is intended to mean more than two, usually limited to from three to five, though more than five are certainly possible. The preferred embodiment employs a control means having a circular washer-like appearance. It should, however, be understood that the broader term "control means" would include configurations other than circular, such as, for example, straight sided.

All of the arms of the boomerang are alike, and taper inwardly toward control ring 36, the juncture with which is a smooth curve. Boomerang 30 has a flat bottom surface and an opposing contoured top surface. The arm/control ring juncture 38 becomes significant when material selection comes into play and will be discussed further below.

The arms and control means are symmetrical about a central axis 37, about which the structure 30 is statically balanced. The device as shown in FIG. 3 would rotate in a counter-clockwise direction.

Figure 4:
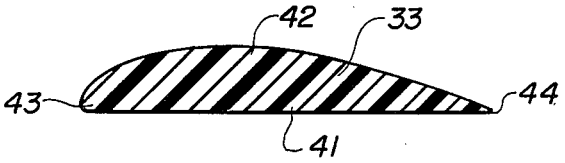
FIG. 4 is a cross sectional view of one arm of the boomerang of FIG. 3, taken along lines 4—4 showing the airfoil shape thereof.

FIG. 4 is a cross sectional of arm 33 of FIG. 3 and shows the airfoil configuration thereof. Arm 33 has a flat bottom 41 and a curved top surface 42 which forms leading and trailing edges 43 and 44, respectively, with bottom surface 41. As one of skill in the art will readily understand, the shape of the arms causes the boomerang to exhibit specific turning characteristics.

Figure 5A:
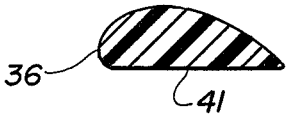
FIG. 5*a* is a cross sectional view of the control ring of the boomerang of FIG. 3, taken along lines 5—5, showing an airfoil shape providing lift toward the top of the boomerang.
Figure 5B:
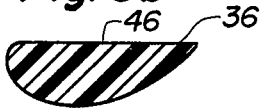
FIG. 5*b* is an alternative embodiment showing a control ring section, similar to FIG. 5*a*, which provides lift toward the bottom of the boomerang.
Figure 5C:
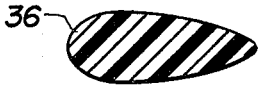
FIG. 5*c* is another alternative embodiment showing a control ring section, similar to that of FIGS. 5*a* and 5*b*, which is streamlined and provides zero lift.

The configuration of the control means or ring 36, establishes the lay-down characteristics, and the modification thereof can be used to match these characteristics to the turning. Now referring to FIG. 5*a*, one alternative configuration of control ring cross section can be seen to comprise an airfoil shape, providing lift toward the top of the boomerang. The flat surface of the airfoil is on the bottom of the boomerang, and, in fact, corresponds to surface 41. FIG. 5*b* is an alternative wherein the flat surface 46 of the airfoil-shaped control ring is on the top of the boomerang. Lift from this configuration is toward the bottom of the boomerang. The final alternative is shown in FIG. 5*c* and has counteracting lift surfaces, the result of which is zero lift. Depending upon arm shape, length, etc., one may modify the cross section of the control means to provide the proper lay-down to match turning.

The control ring provides precise control over the rate of lay-down. If a boomerang has insufficient lay-down, the addition of a ring with the airfoil lifting upward can correct it. If the boomerang has excessive lay-down, the inverted airfoil, lifting downward can correct it. The magnitude of the corrective effect may be varied by changing the diameter of the ring and the camber (curvature) of the airfoil.

The importance of the alternative control means configuration can be more readily appreciated by understanding that each boomerang design has specific structural characteristics which affect its turning pattern. Arm configuration, arm length, and total mass are but a few. One objective of the instant invention is to allow the designer to easily match lay-down characteristics to the rate of turning of his design. If the boomerang lays down properly, it will (1) finish its return with a short section of straight flight; (2) cease all forward motion when it reaches the thrower (preferably changing to a gentle hovering descent); or (3) if thrown too hard, cease forward motion after passing the thrower, then reverse direction and return to the thrower. The addition of a control means, as taught herein, and the modification of the shape thereof, also is taught herein, provides this needed convenience for the designer and gives him capabilities heretofore unknown.

Another aspect of the instant invention is the use of resilient materials, which, in combination with the unique design hereof, results in a boomerang which exhibits not only outstanding operation and functional characteristics, but also a degree of safety which was heretofore impossible to achieve. The term "resilient" as used herein covers a fairly broad range of materials which exhibit at least some amount of flexibility when formed into the desired shapes. Low density polyethylene with a modulus of elasticity (in tension) in the range of from about $0.21\times10^5$ to about $0.27\times10^5$ has proven quite satisfactory. Generally, any material with a modulus of elasticity below about $1\times10^5$ would be suitable; however, materials above this value will also prove quite operable, though less safe.

The design features which promote safety in this boomerang are (1) low total mass, (2) minimum mass at arm tips, (3) small diameter, and (4) flexible arms, junctions, and control ring. Conventional boomerangs are notoriously dangerous to persons and property. Their relatively high mass, rigidity and rotational speeds have been known to cut heads, break fingers, dent cars, break windows and generally add a dubulous character to the entertainment value of the devices.

Referring again to FIG. 3, it can be appreciated that a boomerang of such design, made of resilient material, will be extremely safe in use. Any force encountered by an arm will be almost entirely absorbed by the boomerang itself, thus causing little or no damage to the object impacted. The arms and the control ring are shaped like an airfoil, giving them a non-symmetrical cross section. Consequently, when they are subjected to bending forces, these parts will twist as well as bend, providing additional dissipation of the impact force. This twisting motion is further aided by the gradual taper of the arms, providing the minimum cross sectional area at the arm/control ring juncture. Furthermore, safety is even more enhanced by a large radius at the end of the arms, as at 39.

Figure 6:
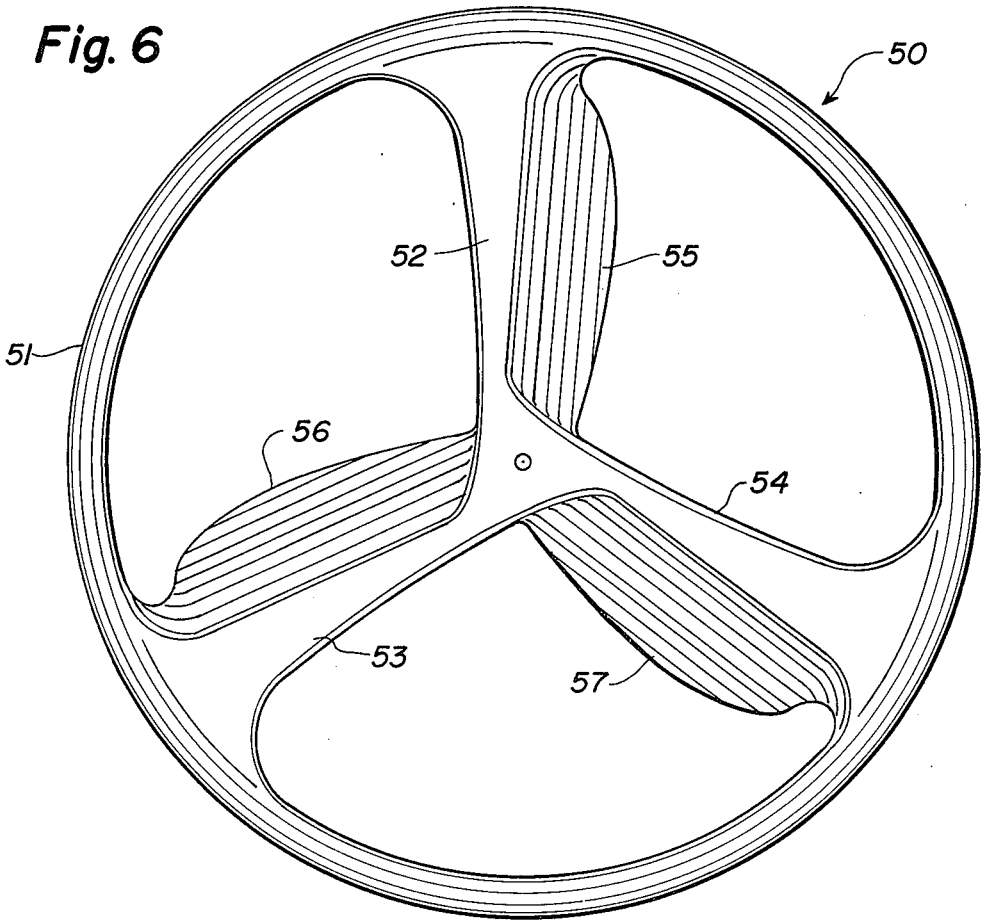
FIG. 6 is an alternative embodiment of a boomerang according to the instant invention with the control ring at the ends of the arms.

The ring may be inside the arms, outside the arms, or at an intermediate radius. It provides substantially the same functions in all positions; however, when the ring is outside the arms, as generally shown in FIG. 6, it partially disrupts the air flow to the arms, making them less efficient. Such boomerangs require a more forceful throw to get a good return.

Boomerang 50 of FIG. 6 has a control ring 51 on the outside of arms 52, 53 and 54. This embodiment is generally similar to those described above, though the airflow problem mentioned in the immediately preceeding paragraph has been greatly reduced by the extension of arm trailing edges 55, 56 and 57 below the flat bottom surface of the boomerang. This permits the air to more readily contact the arms and produce an aerodynamic effect. The outside ring is obviously the most safe configuration, with no arms at all to impact the thrower or other objects. As seen in this figure, the boomerang would rotate in a counter-clockwise direction.

It will be understood that various other changes of the details, materials, steps, and arrangement of parts and uses which have been herein described and illustrated in order to explain the nature of the invention will occur to and may be made by those skilled in the art upon a reading of this disclosure, and such changes are intended to be included within the principles and scope of this invention.

Having thus described the invention, what is claimed is:

1. In a boomerang with a plurality of airfoil-shaped arms spaced about a central axis and extending outwardly thereabout the improvement wherein:

the boomerang has a top surface and an opposing bottom surface and an airfoil-shaped lift producing control means interconnecting said plurality of arms, said control means being generally open-centered and symmetrical about said central axis, said airfoil-shaped arms providing a net lift toward said top surface, said control means providing a net lift toward said bottom surface for controlling lay down.

2. The boomerang of claim 1 wherein:

said control means and said arms are statically balanced about said axis.

3. The boomerang of claim 2 wherein:

said control means comprises a ring.

4. The boomerang of claim 3 wherein:

said arms are spaced symmetrically about said axis.

5. The boomerang of claim 4 wherein:

said arms do not extend inwardly toward said axis beyond the inner periphery of sai ring.

6. The boomerang of claim 5 wherein:

said arms and ring are generally planar and comprise a resilient material.

* * * * *